United States Patent [19]

Lohwasser

[11] 4,140,844

[45] Feb. 20, 1979

[54] POLYACRYLONITRILE FILAMENT YARNS

[75] Inventor: Hermann Lohwasser, Dormagen, Fed. Rep. of Germany

[73] Assignee: Bayer Aktiengesellschaft, Leverkusen, Fed. Rep. of Germany

[21] Appl. No.: 860,620

[22] Filed: Dec. 14, 1977

[30] Foreign Application Priority Data

Dec. 24, 1976 [DE] Fed. Rep. of Germany ..... 2658916

[51] Int. Cl.[2] ..... C08F 2/00

[52] U.S. Cl. ..... 526/341; 264/206; 428/364; 526/342

[58] Field of Search ..... 264/206; 526/341, 342; 428/364

[56] References Cited

U.S. PATENT DOCUMENTS

| | | | |
|---|---|---|---|
| 2,649,427 | 8/1953 | Marvel | 264/206 |
| 2,811,409 | 10/1957 | Clarr et al. | 264/206 |
| 2,975,022 | 3/1961 | Fuler | 264/206 |
| 3,975,337 | 8/1976 | Reicher et al. | 264/206 |

FOREIGN PATENT DOCUMENTS

| | | | |
|---|---|---|---|
| 502315 | 5/1954 | Canada | 264/206 |
| 709995 | 6/1954 | United Kingdom | 264/206 |

*Primary Examiner*—Jay H. Woo

*Attorney, Agent, or Firm*—Plumley and Tyner

[57] ABSTRACT

The invention relates to dry-spun polyacrylonitrile filament yarns having a tensile strength of at least 47 cN/tex and an individual filament denier of at most 1.5 dtex and preferably an overall denier of 20 to 145 tex as well as to a process for the production thereof by spinning, hot drawing and relaxing, wherein the spun filaments are drawn during spinning to such an extent that, after subsequent hot drawing in a ratio of from 1:6 to 1:10 and relaxation, the individual filaments have a denier of at most 1.6 dtex.

3 Claims, No Drawings

POLYACRYLONITRILE FILAMENT YARNS

This invention relates to dry-spun, polyacrylonitrile filament yarns having improved tensile strengths.

It is known that polyacrylonitrile filament yarns can be produced by dry spinning acrylonitrile polymers or copolymers from solutions in dimethyl formamide.

However, on account of the particular nature of the dry spinning process, there are limits to the spinning and drawing possibilities. The limitations on spinning arise from the fact that, for a given spinning output, the number of yarn-forming individual filaments can only be varied within narrow limits in the interest of spinning safety, so that, for example, the final deniers (relaxed) are no finer than 2.0 to 2.3 dtex.

Limitations on hot drawing include inter alia the fact that, where drawing ratios of more than about 5 to 10-fold are applied, unsatisfactory filament travel characteristics or losses of yarn strength are inevitable. Accordingly, it has not yet been possible to produce polyacrylonitrile filament yarns with strengths of more than about 45 cN/tex.

It has now been found that the strength of polyacrylonitrile filament yarns produced by the dry spinning process can be improved by subjecting the filaments to considerably higher drawing during the spinning operation.

Accordingly, the present invention provides dry-spun, polyacrylonitrile filament yarns having a tensile strength of at least 47 cN/tex and an individual filament denier of at most 1.6 dtex.

The invention also provides a process for the production of dry-spun, polyacrylonitrile filament yarns having a tensile strength of at least 47 cN/tex by spinning, hot drawing and relaxing, wherein, during spinning, the filaments are subjected to drawing to an extent that, after subsequent hot drawing in a ratio of from 1:6 to 1:10 and relaxation, the individual filaments have deniers of at most 1.6 dtex.

The draw applied during spinning is defined by the numerical ratio of filament yarn take-off rate (in 1000 m/minute) to polymer throughput per spinning bore (in g/min.) which ratio is referred to hereinafter as the spinning factor. According to the invention, the spinning factor should reach a value of at least 0.8.

For a constant spinning duct capacity and a constant number of spinning bores, the spinning factor increases with the spinning take-off rate whereas, for a given duct capacity and take-off rate, the spinning factor also increases with decreasing polymer throughput per spinning bore when the entire polymer throughput can be maintained through correspondingly numerous bores. This would correspond to an attenuation of the individual filaments.

In principle, this attenuation of the individual filaments should be obtained merely by increasing the number of bores per spinning jet for otherwise the same duct capacity. However, it has been found that in these circumstances it is no longer possible to spin, for example, the spinning denier 1670 dtex for a total spinning capacity of approximately 22 g of polymer per minute with an increase from 96 to 201 in the number of spinning bores in the 150 mm diameter ring.

It has also been found that, for otherwise constant conditions, an increase in the spinning take-off rate, for example for a factor of 178:100, and simultaneously a 100:178 reduction of the original hot drawing ratio caused a lower tensile strength of the filament yarns than before the oppositely directed change in the take-off rate and after-drawing.

Finally, it was found that an increase in the hot drawing ratio, for example to 12-fold drawing, of a spun filament yarn of dtex 1670 f 96, and relaxation of the drawn filament yarn produced a yarn tensile strength of only 37.5 cN/tex although giving a fine individual denier of 1.7 dtex.

Accordingly, it was completely surprising that fine-capillary filament yarns having improved tensile strengths and satisfactory travel characteristics could be produced by subjecting the dry spun polyacrylonitrile filament yarns to a high draw during spinning coupled with a high afterdraw.

In its narrowr sense, the after-drawing ratio or drawing ratio is the ratio between the peripheral speeds of the take off godet and the heating godet which is adjusted during the hot drawing process.

Hot drawing is preferably carried out by the process described in German Auslegeschrift No. 1,268,778 using the apparatus which is also described therein.

According to a particular embodiment, the process according to the invention is characterised as follows:

Annular spinning jets having diameters of 150 mm and more are particularly suitable for dry spinning. By suitably arranging the bores, the spinning jets may be designed for single-filament or multifilament spinning. Using solutions of the acrylonitrile polymer or copolymer in a polar solvent, such as N,N-dimethyl formamide or N,N-dimethyl acetamide, the spinning streams are extruded into heated air for coagulation and the spun filaments are taken up on bobbins, optionally following the application of a lubricant. The spinning factor should reach a value of at least 0.8. The optimum results in regard to the polymer used, its solution concentration, the dimensions of the spinning jet, the spinning rate and the spinning safety may readily be obtained by simple tests.

The filament packages thus obtained are fitted onto single-stage or two-stage drawing or draw-twisting machines which must be equipped with heatable feed godets and stretching yokes and which provide for drawing in the range from 6-fold to 10-fold (600% to 1000%). One preferred embodiment is based on the hot drawing assembly described in German Auslegeschrift No. 1,268,778 which has godet diameters of 100 mm and a yoke length of 400 mm. Drawing ratios of from 800 to 1000% for drawing take off rates of from 100 to 300 m/minute have proved to be optimal. The drawn material, based on polyacrylonitrile, is characterised by a boiling-induced shrinkage of about 15 to 16% and in the case of copolymers even higher. According to the invention, the drawing step is followed by relaxation of the drawn filament yarn which may be carried out in the tension-free state by the action of water, steam, hot air or other inert media at temperatures of from 100° C. to 140° C. It is preferred to subject the drawn filament yarn in strand or soft-package form to a treatment with steam until no more shrinkage can be detected. Shrinkage may also be carried out in continuous installations by continuous passage through a shrinkage chamber. The relaxation step produces a considerable increase in tensile strength and elongation at break to beyond the level of the drawn filament yarn stage. If desired, it may also be followed by after-twisting or winding and the like on suitable textile machines.

The acrylonitrile polymers used for the process according to the invention may be pure polymers or even copolymers provided that they contain at least 97% by weight of copolymerised acrylonitrile. Comonomers which may be copolymerised with acrylonitrile include the compounds known in this art, preferably methacrylonitrile, acrylamide, metallyl sulphonic acid and its salts. It is preferred to use acrylonitrile homopolymers produced by conventional methods. Spinning additives for example, identification dyes or matting agents, may be used.

By virtue of the greater fineness of the individual filaments and the improved yarn strengths, the polyacrylonitrile filament yarns according to the invention afford certain advantages in regard to processing and application such as, for example, the ready spliceability of yarn ends, easy raising and stitching of fabrics when applying the corresponding finishing processes, better filtration capacity, stronger adhesion of resin finishes and also improved fabric stability under thermal and hydrolytic loads. In their non-twisted state, they form an excellent starting point for graphiting (carbonising) purposes.

Depending upon the member of spinning jets selected and, optionally, by doubling filament yarns, it has been possible in accordance with the present invention to produce polyacrylonitrile filament yarns with total finenesses of from about 10 to 180 tex for a maximum individual filament denier of 1.6 dtex. Examples are filament yarns such as dtex 110 f 96, dtex 220 f 144, dtex 220 f 201, dtex 450 f 360, dtex 885 f 768, dtex 1340 f 1152 and others in the range of the above-mentioned finenesses. The preferred range extends from 20 to 145 tex.

In the following Examples and Comparison Examples, contents of N,N-dimethyl formamide (DMF), preparation (oil) and extractable fractions in the filament yarns are expressed in % by weight, based on the dry mass (PAN). Effective yarn finenesses describe the condition of the material, including DMF and oil. Tensile strength and elongation at break were measured in a Wolpert apparatus.

EXAMPLE 1

A 25% solution of polyacrylonitrile in DMF was dry spun at a throughput of 22.2 g of PAN/minute through a spinning jet having 144 bores with a diameter of 0.2 mm, so that a 1760 dtex filament yarn containing 13% of DMF was obtained for a take-off rate of 126 m/minute. 2.4% of an oil preparation was applied during winding. The spun material (spinning factor 0.82) was drawn in a ratio of 1:9.3 in a drawn-twisting arrangement by a single passage over a heating godet at 147° C. a yoke at 145° C. and an unheated take-off godet, the filament yarn being looped several times around each godet. The drawn filament yarn wound onto cops had a total denier of effectively 204 dtex, a DMF-content of 9.4% and a boiling-induced shrinkage of 16%. A fully shrunk DMF-free filament yarn of dtex 224 f 144 Z 150 was obtained therefrom by after-twisting and steaming under pressure at 125° C. in package form. Tensile strength 47.0 cN/tex, elongation at break 18.1%.

When spinning jets having only 96 or 72 bores (spinning factor 0.55 and 0.41, respectively) were used under otherwise the same spinning and after-treatment conditions, the tensile strengths fell to 45.6 and 43.5 cN/tex, respectively.

EXAMPLE 2

A 24.5% solution of polyacrylonitrile in DMF was dry-spun at 242 meters per minute (PAN throughout 48.0 g/minute) through 192 spinning bores with a radius of 0.1 mm into a dtex 1980 f 192 filament yarn with a DMF-content of 15.0% and an oil application of 2.65% (spinning factor 0.97). The material was drawn in a ratio of 1:9.3 under the same conditions as described in Example 1 into a drawn filament yarn with an effective denier of dtex 200 f 192 and a boiling-induced shrinkage of 15%. A twisted filament yarn of dtex 220 f 192 Z 145 was produced by steaming in package form at 120° C. and twisting. Tensile strength 53.0 cN/tex, elongation at break 18.2%.

By contrast, a filament yarn according to the present invention was not achieved by two-yarn spinning through a jet with 2 × 96 bores. The as-spun single yarns could only be hot-drawn in a ratio of 1:5.3. The filament yarns obtained had a denier in their relaxed form of dtex 235 f 96, a tensile strength of 43 cN/tex and an elongation at break of 24.6%.

EXAMPLE 3

A yarn of denier dtex 3380 f 384 containing 14.9% of DMF and 2.6% of an oil preparation was produced in the manner described in the preceding Examples except that the dry spinning of polyacrylonitrile was carried out at a rate of 2 × 41.0 g/minute through two 160 mm jets each having 192 bores 0.25 mm in diameter, followed by combined winding into package form at a rate of 242 m/minute. By drawing two such packages (spinning factor 1.13) together in a ratio of 1:9.3, followed by after-twisting and steaming in package form, it was possible to obtain a shrinkage-free yarn of denier dtex 885 f 768 Z 150. Tensile strength 48.3 cN/tex, elongation at break 18.5%.

When an attempt was made to produce filament yarns with the same overall denier for a proposed drawing ratio of 1:9.6 through a single jet having 201 bores 0.2 mm in diameter by reducing the spinning take-off rate to 126 meters per minute, it was not possible to obtain any filaments (spinning factor 0.59).

EXAMPLE 4

A 25.6% solution of a copolymer of 99% by weight of acrylonitrile and 1% by weight of sodium methallyl sulphonate in DMF was dry-spun through a ring jet comprising 2 × 96 bores with a radius of 0.01 cm with a PAN throughput of 2 × 17.5 g/minute and at a spinning take-off rate of 209 meters per minute, to form two separate filament yarns of each dtex 836 f 96 containing 12.5% of DMF and 3% of preparation (spinning factor 1, 15). The drawn filament yarn, obtained as described in Example 1 with the godet temperature 144° C., the yoke temperature 148° C. and the drawing ratio 1:8.0, was taken up onto cops. Relaxation was carried out by treating a loose strand of drawn filament yarn in boiling tetrachloroethylene. An untwisted yarn of dtex 116 f 96, free from residual DMF and spinning preparation, was obtained. Tensile strength 52.6 cN/tex, elongation at break 19.0%.

A similarly prduced filament yarn of 97.2% by weight of acrylonitrile and 2.8% by weight of acrylamide hot drawn in the same ratio of 800% gave a yarn with a denier in its relaxed state of dtex 124 f 96, a tensile strength of 50.5 cN/tex and an elongation at break of 20.8%.

EXAMPLE 5

A 23.6% solution of polyacrylonitrile in dimethyl formamide was spun through different ring jets with the same bore diameter of 0.2 mm with a PAN throughput per jet of 34.0 g/minute in a dry spinning duct under otherwise the same spinning duct conditions. by applying a spinning take-off rate of 204 m/minute, it was possible to obtain 1660 dtex (±2%) spun filament yarns for a nominal denier of 220 dtex with filament numbers of 96, 144, 201 and 240 (A, B, C, D).

The spun yarns were subjected to 9.6-fold drawing in a draw-twisting machine of the type mentioned above, in which the temperatures of the heating godet and stretching yoke were appropriately adapted, at a take-off rate of 226 meters per minute to form drawn filament yarns having the following properties:

Table 1

| | Effective yarn denier | Extractable fractions (% by weight) | Tensile strength (cN/tex) | Elongation at break (%) |
|---|---|---|---|---|
| A) | dtex 204 f 96 | 16.1 | 35.6 | 8.7 |
| B) | dtex 200 f144 | 14.5 | 36.5 | 8.4 |
| C) | dtex 193 f201 | 13.0 | 39.1 | 7.9 |
| D) | dtex 192 f240 | 11.4 | 38.0 | 7.8 |

The drawn filaments were rewound with 90 Z-twists/m to form 1.2 kg packages which were thoroughly steamed at 120° C. The result of the spinning factor increasing in the order A to D is shown in Table 2.

Table 2

| Twisted yarn | Spinning factor | Yarn fineness, twisting | Filament fineness (dtex) | Tensile strength (CN/tex) | Elongation at break (%) |
|---|---|---|---|---|---|
| A | 0.58 | dtex 220 f 96 Z 150 | 2.25 | 45.7 | 18.8 |
| B | 0.86 | dtex 210 f 144 Z 150 | 1.5 | 47.8 | 17.9 |
| C | 1.21 | dtex 210 f 201 Z 150 | 1.1 | 49.6 | 17.0 |
| D | 1.44 | dtex 210 f 240 Z 150 | 0.9 | 49.1 | 17.8 |

Table 2-continued

EXAMPLE 6

At a spinning take-off rate of 262 m/minute and with a polymer throughput of 23.3g PAN/minute (spinning factor 1.08), a spinning solution of 24.2% of polyacrylonitrile, 0.2% of titanium dioxide pigment and 75.6% of dimethyl formamide was dry-spun into partly doubled filament yarns with yarn deniers of dtex 888 f 96, dtex 1763 f 192 and dtex 3560 f 384. The spun yarns had a DMF-content of 15.8 ± 3.0% and an oil preparation content of 2.7%. The following drawn filament yarns were produced as described in Examples 1 to 3, where necessary by additional combination of single stretched yarns, from the spun filament yarns with a drawing ratio of 1:9.3 and at a godet and heating yoke temperature of 150 ± 5° C.

(E) dtex 104 f 96 for a drawing take-off of 301 m/min.
(F) dtex 208 f 192 for a drawing take-off of 226.m/min.
(G) dtex 415 f 384 for a drawing take-off of 115 m/min.
(H) dtex 820 f 768 for a drawing take-off of 170 m/min.
(I) dtex 1270 f 1152 for a drawing take-off of 170 m/min.
(J) dtex 204 f 192 for a drawing take-off of 115 m/min.

The drawn cops were twisted in package form (100 Z twists/meter) in a double-twist twisting machine, the packages were fully shrunk by steaming under pressure and then rewound with application of a little preparation oil. Satisfactorily smoothed twisted yarns with the following textile data were obtained (Table 3).

Table 3

| Twisted yarn | Extractable fractions (% by weight) | Yarn fineness, twisting | Tensile strength (cN/tex) | Elongation at break (%) |
|---|---|---|---|---|
| E | 2.6 | dtex 110 f 96 Z 140 | 48.7 | 16.4 |
| F | 2.9 | dtex 217 f 192 Z 145 | 48.5 | 17.0 |
| G | 2.8 | dtex 440 f 384 Z 150 | 49.0 | 17.8 |
| H | 3.0 | dtex 915 f 768 Z 150 | 47.1 | 19.6 |
| I | 3.0 | dtex 1340 f 1152 Z 150 | 48.0 | 19.8 |
| J | 2.7 | dtex 220 f 192 Z 155 | 53.5 | 18.0 |

What I claim is:

1. A dry-spun polyacrylonitrile filament yarn having a tensile strength of at least 47 cN/tex and an individual filament denier of at most 1.6 dtex.

2. The filament yarn of claim 1 having an overall denier of from 20 to 145 tex.

3. The filament yarn of claim 1 comprising a copolymer consisting of at least 97% by weight of copolymerised acrylonitrile.

* * * * *